US007903956B2

(12) United States Patent
Colburn et al.

(10) Patent No.: US 7,903,956 B2
(45) Date of Patent: Mar. 8, 2011

(54) RAPID LIQUID HEATING

(75) Inventors: Michael George Colburn, Burlington, VT (US); Stephen John Bogner, Colchester, VT (US)

(73) Assignee: Wood Stone Ideas, LLC, Bellingham, WA (US)

( * ) Notice: Subject to any disclaimer, the term of this patent is extended or adjusted under 35 U.S.C. 154(b) by 0 days.

(21) Appl. No.: 12/542,539

(22) Filed: Aug. 17, 2009

(65) Prior Publication Data

US 2010/0040352 A1 Feb. 18, 2010

Related U.S. Application Data

(63) Continuation of application No. PCT/US2009/053798, filed on Aug. 13, 2009.

(60) Provisional application No. 61/088,720, filed on Aug. 13, 2008, provisional application No. 61/178,970, filed on May 16, 2009.

(51) Int. Cl.
*H05B 3/60* (2006.01)

(52) U.S. Cl. ..... 392/311; 392/312; 392/316; 392/322

(58) Field of Classification Search ..... 392/311, 392/312, 316, 322
See application file for complete search history.

(56) References Cited

U.S. PATENT DOCUMENTS

| | | | |
|---|---|---|---|
| 2,428,445 | A | 10/1947 | Cyro |
| 2,757,272 | A | 7/1956 | Mariano |
| 2,783,355 | A | 2/1957 | Vassiliev |
| 3,978,313 | A | 8/1976 | Curchod |
| 4,029,937 | A | 6/1977 | Russell |
| 4,119,833 | A | 10/1978 | Welch |
| 4,163,895 | A | 8/1979 | Hauser |
| 4,205,222 | A | 5/1980 | William |
| 6,074,621 | A | 6/2000 | Hsiung et al. |
| 6,365,881 | B1 | 4/2002 | Itzhak |
| 6,640,048 | B2 | 10/2003 | Novotny |
| 7,050,706 | B2 | 5/2006 | Israelsohn |

FOREIGN PATENT DOCUMENTS

| | | | |
|---|---|---|---|
| JP | 2000-074496 | A | 3/2000 |
| KR | 10-1999-0054160 | A | 7/1999 |
| KR | 10-0733304 | B1 | 6/2007 |
| KR | 10-2008-0030842 | A | 4/2008 |
| WO | WO2009/100486 | A1 | 8/2009 |

OTHER PUBLICATIONS

Shelley, Tom Putting Heat Only Where It's Needed Acticle Date Mar. 17, 2007 Findley Media, copyright 2009 United States.

Oregon State University—Sea Grant, "capacitive dielectric heating" Report NOAA Office of Sea Grant and Extramural Programs US Department of Commerce Aug. 2002—United States.

*Primary Examiner* — Thor S Campbell
(74) *Attorney, Agent, or Firm* — James Marc Leas

(57) ABSTRACT

A device for heating a liquid includes a tank, electrodes, and a conductive liquid. The tank holds the conductive liquid and the electrodes. The electrodes are connected to provide current flowing in the conductive liquid. The device also includes an electrolytic material supply vessel for holding the electrolytic material. The electrolytic material supply vessel is switchably connected for providing the electrolytic material to the tank. The device also includes an electrical parameter sensor for detecting a parameter of electrical energy dissipated in the conductive liquid. The device also includes a controller connected to automatically add the electrolytic material to the conductive liquid if the electrical parameter sensor detects the electrical parameter differing from a set point.

16 Claims, 6 Drawing Sheets

RAPID LIQUID HEATING

RELATED APPLICATIONS AND PRIORITY

This patent application is a continuation of PCT application PCT/US09/53798 filed Aug. 13, 2009, entitled "Rapid Liquid Heating," which claims the benefit of U.S. provisional patent applications 61/088,720 filed Aug. 13, 2008, entitled "Ohmic Liquid Heating," and 61/178,970 filed May 16, 2009, entitled "Food Steamer Containers with Sequential Ohmic Water Heating," all of which are incorporated herein by reference. This patent application is related to PCT application PCT/US09/53794, filed Aug. 13, 2009, entitled "Food Steamer Containers with Sequential Ohmic Water Heating," ("the '794 application") incorporated herein by reference.

FIELD

This patent application generally relates to liquid heating. More particularly it relates to a system for heating a liquid by flowing a current through the liquid.

BACKGROUND

In standard resistance heating of a liquid, electrical current passes through a resistive heating element that converts electrical energy into heat. The heat conducts from the hot resistive heating element to the liquid, heating the liquid. This scheme is widely used in devices such as residential and commercial water heaters, appliances, such as dishwashers, and industrial processes. In heating water, the scheme has produced problems because the surface of the resistance heating element becomes much hotter than the liquid to be heated. This higher surface temperature causes chemicals and impurities in the liquid to react, to precipitate out of the liquid, and to adhere to the hot surface of the resistance heating element, forming a lime coating on its sheathing. Over time this lime layer builds up, and acts as a thermal insulator. Thus, the now insulated resistance element gets hotter, wasting energy. As it operates at an even hotter temperature the resistance element eventually burns out. In addition, in heating of the liquid with a standard resistance heater the electrical energy dissipated in the resistor has to first heat the resistance heating element, then the resistance element's sheathing, then any lime buildup on the element's sheathing surface, and then finally the liquid. Thus, the heating of the liquid comes after some delay.

To address these problems, the lime coating on the resistance heater may be periodically removed from the appliance for deliming to prevent burn out and frequent replacement. The maintenance process of removing the mineral surface deposits takes time, adding cost and may use harsh chemicals which are damaging to the environment, costly and potentially dangerous.

Thus, better techniques for heating liquids are needed, and these techniques are provided in this patent application.

SUMMARY

One aspect of the present patent application is a device for heating a liquid. The device includes a tank, electrodes, and a conductive liquid. The tank holds the conductive liquid and the electrodes. The electrodes are connected to provide current flowing in the conductive liquid. The device also includes an electrolytic material supply vessel for holding the electrolytic material. The electrolytic material supply vessel is switchably connected for providing the electrolytic material to the tank. The device also includes an electrical parameter sensor for detecting a parameter of electrical energy dissipated in the conductive liquid. The device also includes a controller connected to automatically add the electrolytic material to the conductive liquid if the electrical parameter sensor detects the electrical parameter differing from a set point.

Another aspect of the present patent application is a method of heating a liquid. The method includes providing a tank and electrodes, wherein the electrodes are located in the tank. The method also includes flowing a conductive liquid between the electrodes wherein the conductive liquid has a conductivity. The method also includes providing a system for adjusting the conductivity. The method also includes flowing a current in the liquid between the electrodes, detecting the current flow, and using the system to automatically adjust conductivity of the liquid to achieve a desired current flow.

Another aspect of the present patent application is a device for heating a liquid. The device includes a plurality of tank sections, an inflow, an outflow, electrodes, a baffle, and a liquid. The plurality of tank sections holds the liquid and the electrodes. The liquid has a conductivity sufficient to pass current between the electrodes. The baffle is between tanks of the plurality of tanks.

Another aspect of the present patent application is a method of heating a liquid. The method includes providing a tank, electrodes, and a liquid, wherein the electrodes are located in the tank. The method includes flowing the liquid between the electrodes. The method includes providing a voltage between the electrodes, flowing a current in the liquid between the electrodes, and without changing the voltage adjusting the current to provide a preset current.

BRIEF DESCRIPTION OF THE DRAWINGS

The foregoing will be apparent from the following detailed description as illustrated in the accompanying drawings, for clarity not drawn to scale, in which.

DETAILED DESCRIPTION

Figure 1A:
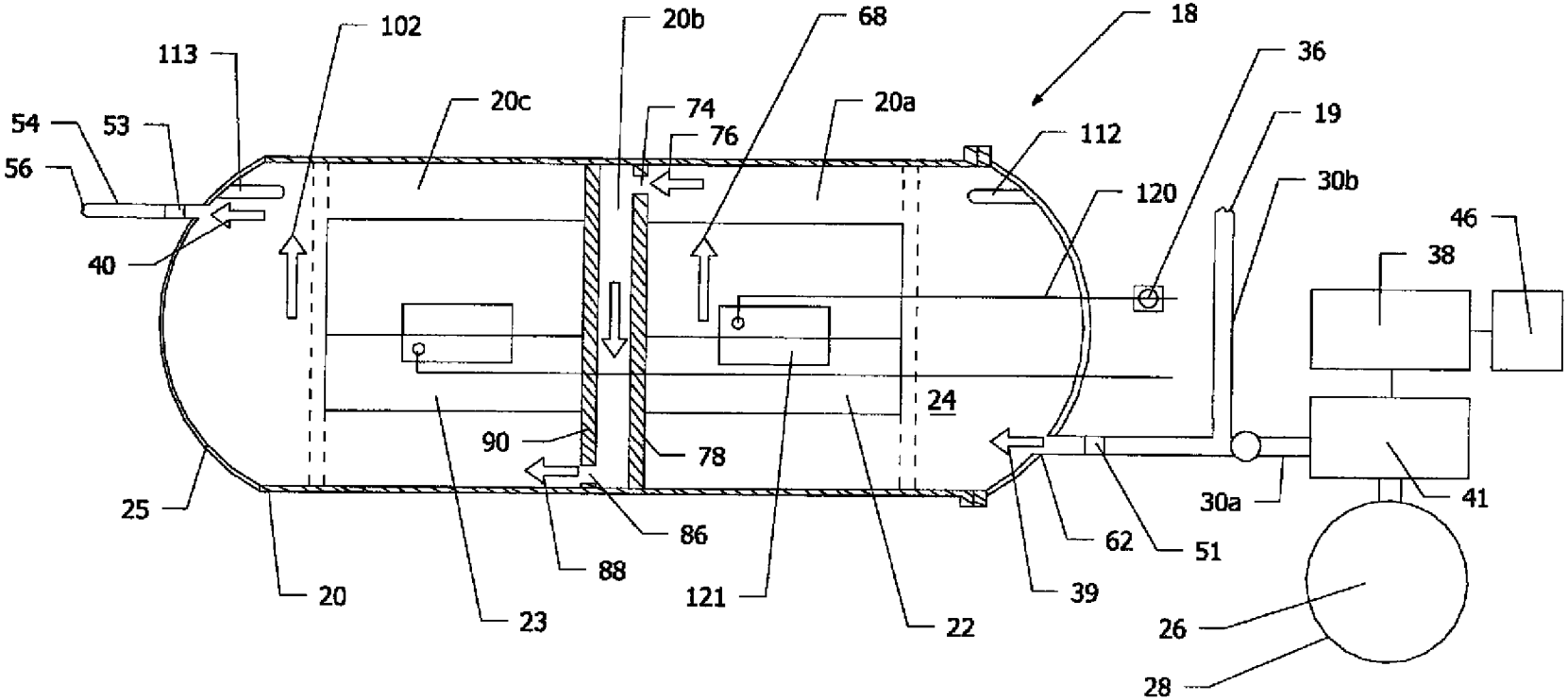
FIG. 1*a* is cross sectional view of one embodiment of a liquid heating system of the present patent application including tank sections having sets of electrode, a pressurized conductive liquid between electrodes, a source of electrolytic material, and a control system for providing the electrolytic material to increase the conductivity of the conductive liquid.
Figure 1B:
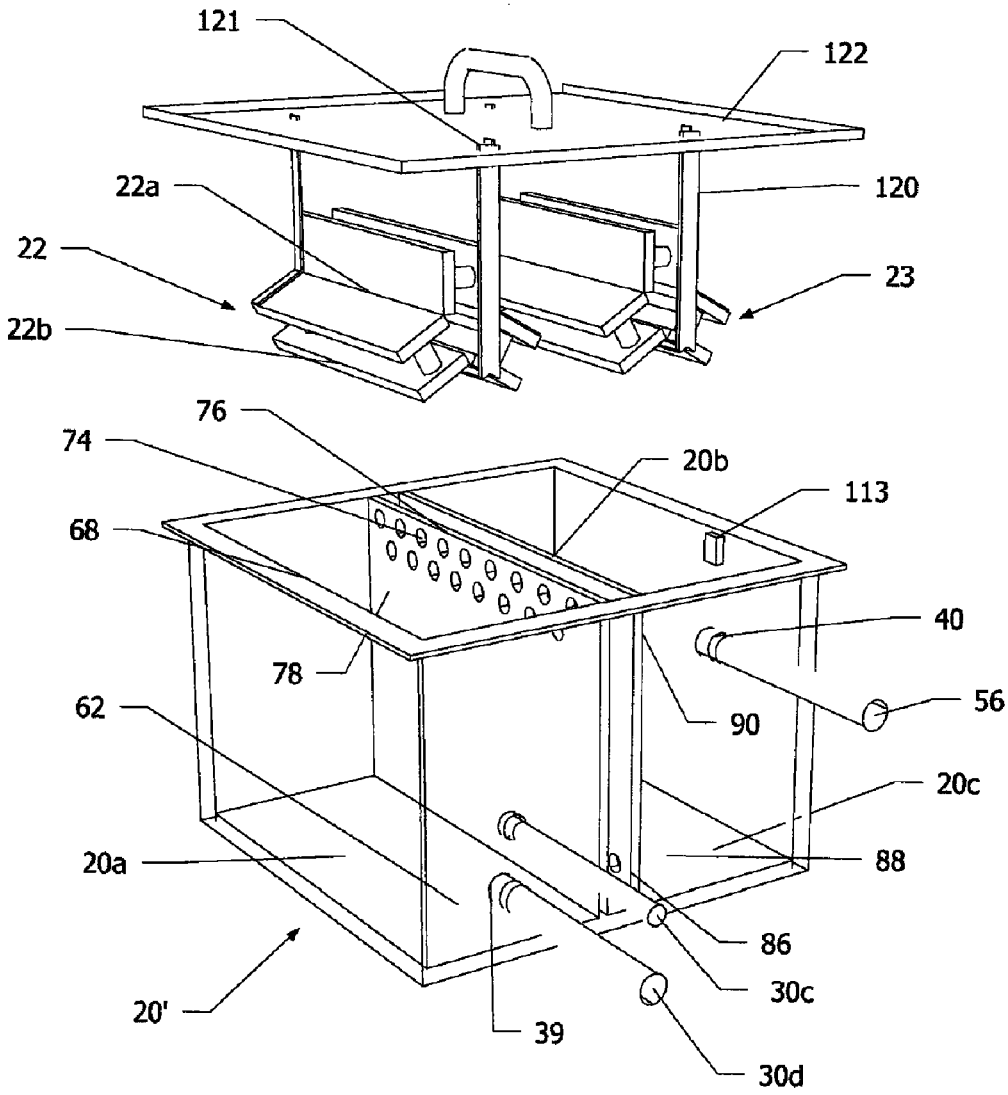
FIG. 1*b* is a three dimensional view of another embodiment of the liquid heating system of FIG. 1*a* in which liquid in the tank is at atomospheric pressure.
Figure 2A:
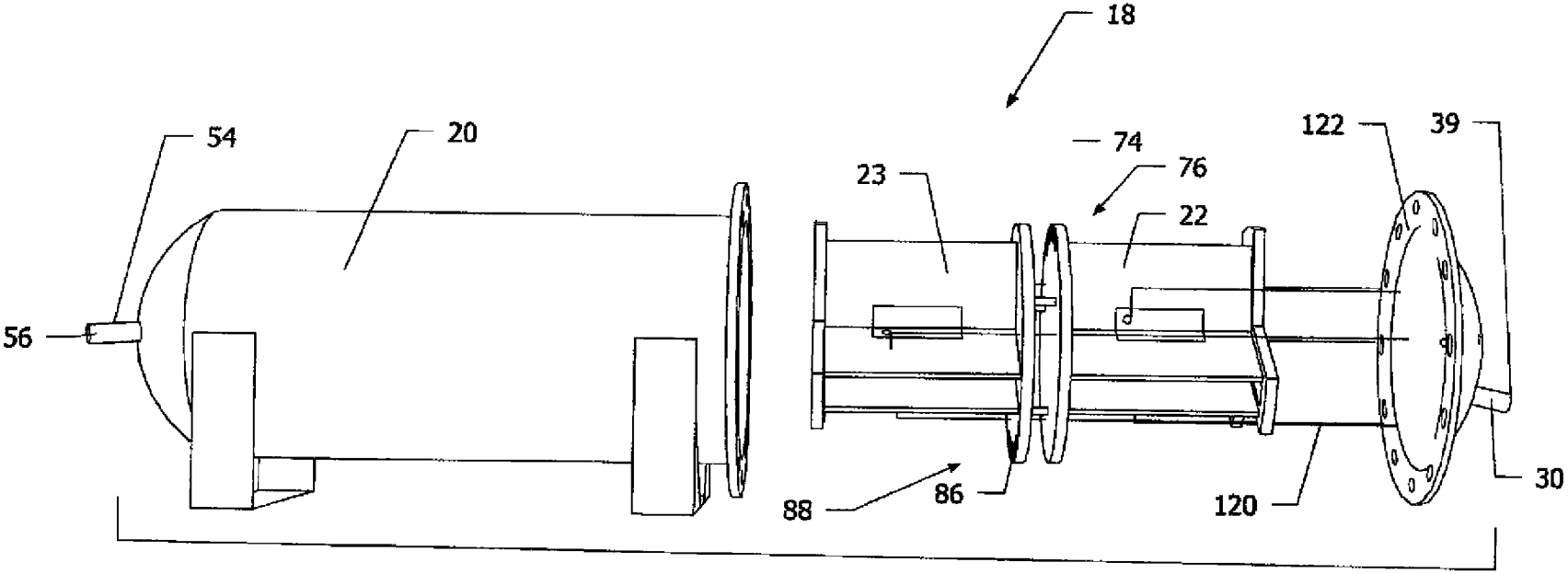
FIG. 2*a* is a three dimensional exploded view of the liquid heating system of FIG. 1*a;*
Figure 2B:
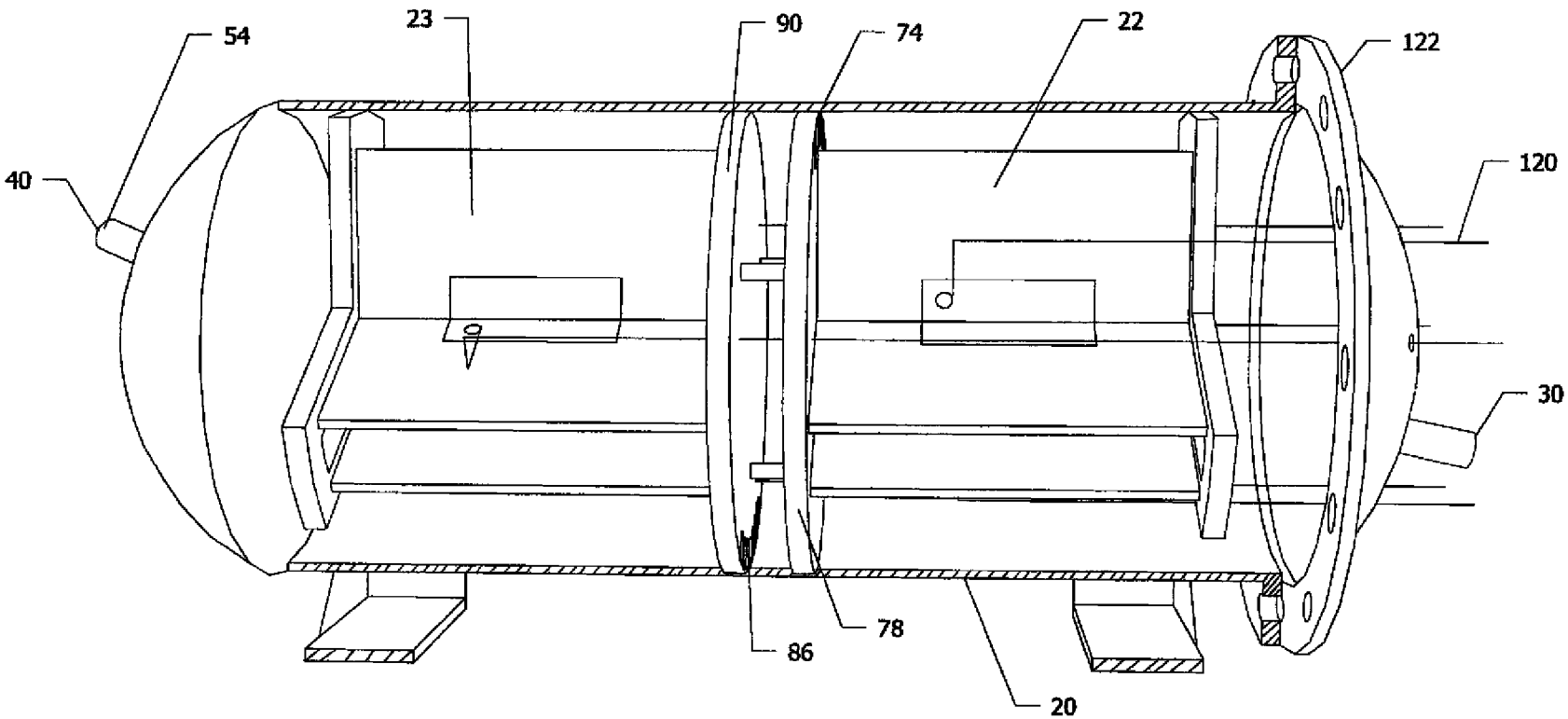
FIG. 2*b* is a three dimensional view of the liquid heating system of FIG. 1*a;*
Figure 2C:
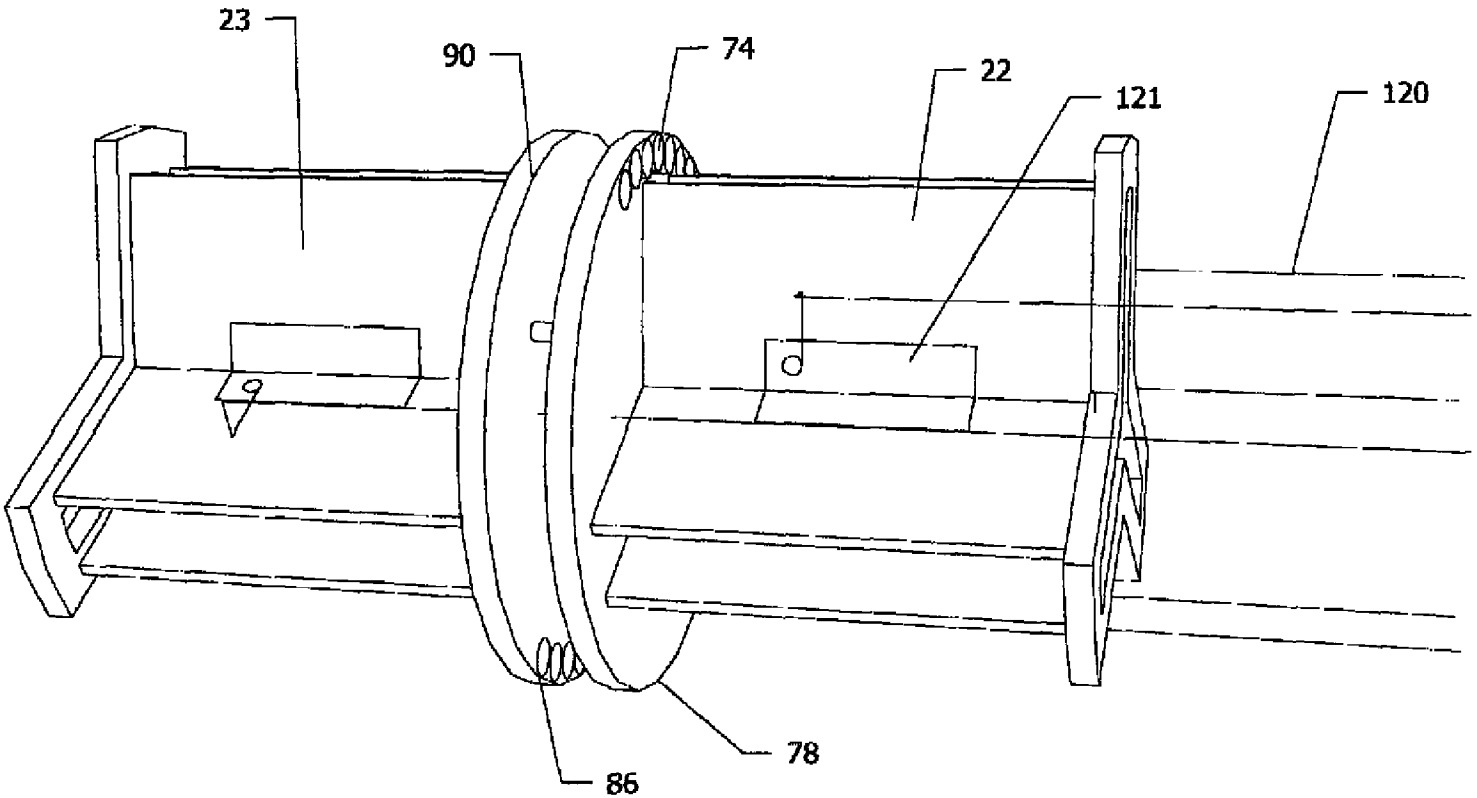
FIG. 2*c* is a three dimensional view of the baffles, electrodes, and leads of liquid heating system of FIG. 1*a*.

Device 18, 18' for heating entering liquid 19 includes tank 20, 20' that holds electrode set 22 in tank section 20*a* and electrode set 23 in tank section 20*c*, as shown in FIGS. 1*a*-1*b*. In one embodiment, three phase electrode set 22 includes electrode plates 22*a*-22*a*', 22*b*-22*b*', 22*c*-22*c*' and three phase electrode set 23 includes electrode plates 23*a*-23*a*', 23*b*-23*b*', 23*c*-23*c*', as shown in FIGS. 2*a*-2*c*. Tank 20 also holds conductive liquid 24 which is electrically isolated from the outside surface of tank 20, 20'. Device 18, 18' can be used to heat a cold liquid 24, boost the temperature of a previously heated liquid or to maintain a liquid temperature.

Tank 20, 20' may be fabricated of a metal, such as steel, that has an inside surface coated with dielectric material 25, such a fluoropolymer, glass, or porcelain. Tank 20, 20' is also insulated and enclosed in a box or container (not shown), further insulating it. For low pressure use, tank 20, 20', 20' can be made of a dielectric material, such as plastic.

In one application, device 18, 18' was used to raise the temperature of entering liquid 19, such as water from a municipal supply system, that flowed through tank 20, 20'. Entering liquid 19 may arrive directly from the municipal water supply system or it may have been previously treated, used, or heated, such as in another heating unit. For example entering liquid 19 may have an entry temperature of 150 F and device 18, 18' is used to boost its temperature to 200 F.

Entering liquid 19 can be water based or have a large component of water, such as sea water, waste water, milk, blood, body fluids, a processed food slurry, an organic waste processing mix, cleaning fluids, beer, or wine. Entering liquid 19 can also be an alcohol, such as ethanol or glycol, or a paraffin based material, such as a heat transfer fluid. If an entering liquid 19 is a liquid other than water-based then electrolytic material 26 includes conductive solutes appropriate for that liquid. Conductive liquid 24, formed from the mixture of entering liquid 19 and electrolytic material 26, allows substantially more current to flow between electrodes of electrode sets 22, 23 than entering liquid 19 by itself would allow. With substantial current flowing, conductive liquid 24 heats during its residence time in tank 20, 20'.

Electrolytic material 26 is added to entering liquid 19 to provide conductive liquid 24 with enhanced conductivity compared to entering liquid 19. Electrolytic material 26 can be a solid or liquid material. In one embodiment, electrolytic material 26 is itself a solution that contains electrolytes. For example, electrolytic material 26 can be an aqueous solution containing salt electrolytes, such as sodium chloride or potassium chloride. In addition to salts, aqueous solutions of such additional water soluble electrolytic materials as sodium carbonate, sodium bicarbonate, trisodium citrate, sodium hydroxide, hydrochloric acid, ammonium nitrate, nitric acid, or acetic acid can be used. Aqueous solutions of other salts or other conductive solutes can also be used. Cleansing agents, rinse agents, or metal protecting agents or mixtures of these agents can be added along with electrolytic material 26.

In one embodiment device 18, 18' includes electrolytic material supply vessel 28 connected to tank section 20*s* through electrolytic supply inlet pipe 30*a* for supplying electrolytic material 26 to tank section 20*a*. Supply can be via a pump or gravity feed. Electrolytic material 26 can be added to entering liquid 19 in inlet pipe 30*b* before entering liquid 19 enters tank section 20*a*, as shown in FIG. 1*a*. Alternatively, electrolytic material 26 can be added to tank section 20*a* through its own inlet pipe 30*c*, separately from entering liquid 19, entering through inlet pipe 30*d*, as shown in FIG. 1*b*.

In another embodiment, the conductive material supply vessel can be separate from device 18, 18'. For example, conductive material supply vessel 28 can be a water softener (not shown) that provides an aqueous solution containing electrolytic salts.

In a prototype, electrolytic material 26 was an aqueous solution of sodium chloride salt having a sodium chloride concentration of 30,000 ppm. Electrolytic material 26 was fabricated by mixing ¼ teaspoon of salt with 7 gallons of water. In an embodiment using municipal water in Winooski, Vt., entering municipal water had a sodium chloride concentration of 90 ppm, and the mixing of this entering municipal water with a carefully metered amount of electrolytic material 26 produced conductive liquid 24 having a sodium chloride concentration in the range of hundreds of ppm.

In one embodiment, device 18, 18' also includes current sensing switch 36 for detecting current flowing to electrode sets 22, 23. Device 18, 18' also includes controlling device 38 connected for using information from current sensing switch 36 to automatically control flow of electrolytic material 26 to tank section 20*a*.

In the prototype described herein above in which entering liquid 19 was municipal water and electrolytic material 26 was the 30,000 ppm sodium chloride salt solution, current sensing switches were used to implement the current sensing and electrolyte solution controlling functions. The present applicants used the current sensing switches to provide a volume of electrolytic material 26 sufficient to provide the municipal water with a conductivity such that with 208 Volts applied between pairs of electrode plates of electrode sets 22, 23, 32 amperes of current flowed. The 32 amperes was more than 60% of the maximum current available from the 50 ampere wall outlet circuit that provided the power. The current set point can be higher, for example the current set point can be 70% or up to 80% of the wall outlet circuit breaker rating. This electric current flowing through conductive liquid 24 between each pair of electrode plates in electrode sets 22, 23 boosted its temperature from about 150 F at the inlet 39 of tank 20, 20' to about 200 F at outflow 40. The heated water was then used for the sanitizing rinse of dishes in a commercial dishwasher. With entering municipal water flowing through tank 20, 20' for this sanitizing rinse at 293 gallons per hour, a small pump was used to mix in the 30,000 ppm sodium chloride salt solution, and sufficient heat was added to conductive liquid 24 by the current flow through conductive liquid 24 during its residence time between electrodes in tank 20, 20' to raise its temperature by 50 degrees F. Measuring conductive liquid 24 flowing out of tank 20, 20', applicants found that it had a sodium chloride concentration of 450 ppm.

Device 18, 18' can also be used for residential heating. For this use entering liquid 19 can be water that recirculates between baseboard heaters and device 18, 18'. In other embodiments, the device receiving the heated water can be a hot water faucet, a shower head, a hot water supply tank, a car wash, a pool heater, or an industrial process that uses hot water. In these embodiments, the municipal water at inlet 39 of tank 20, 20' can be at a temperature such as room temperature or below. Device 18, 18' provides heated water at outflow 40 is at a preset hot water temperature. The water arriving at inlet 39 can already be conductive if, for example, it includes electrolyte from a water softener or if it is recirculating water that previously had electrolyte added.

Device 18, 18' allows for increasing or decreasing the concentration of electrolyte in conductive liquid 24 flowing through tank 20, 20' to maintain a desired current level. To increase the concentration of electrolyte in conductive liquid 24, more electrolytic material 26 was injected. In one embodiment, this was accomplished by pumping in solution 26 for longer increments of time while plain municipal water was flowing into tank 20, 20'. To decrease the concentration of electrolyte in conductive liquid 24, electrolytic material 26 was pumped into tank 20, 20' for shorter amounts of time while plain municipal water was flowing into tank 20, 20'. Thus, device 18, 18' allows for changing the concentration of conductive solutes in liquid 24 in either direction.

Increasing the concentration of conductive solutes dissolved in conductive liquid 24 increases the conductivity of conductive liquid 24 which increases current flowing through conductive liquid 24 at a given applied voltage. Increasing the current increases the heating rate proportionally, since the heating rate is the current times the voltage. Similarly, decreasing the concentration of conductive solutes decreases the heating rate.

Pump 41 is connected for supplying electrolytic material 26 from conductive material vessel 28 to tank 20, 20' through inlet pipe 30. In one apparatus set up by applicants, model PQM-1/230 AC motor driven gear pump obtained from Greylor Company, Cape Coral, Fla., was used. Other pumps, such as the Mec-o-matic VSP series peristaltic pump modul number VSP20 from Pulsafeeder, Inc., an unit of Idex Corporation, can also be used.

In prototypes, the present applicants implemented controlling device 38 with normally open current sensing switch 36 and normally closed current sensing switch 42, as shown in FIGS. 4*a*, 4*b*. Such current sensing switches are available from Eaton Corporation, Cleveland, Ohio, with part numbers ECSNOASP and ECSNCASP respectively. Normally open current sensing switch 36 closes, turning on pump 41 and opening valve 110 when current falls below a set point of 32 amperes.

Normally closed current sensing switch 42 opens when the current reaches a set point, such as 38 amperes. Normally closed current sensing switch 42 operates as a high current safety and is wired in series with current sensing switch 36, providing this over-amperage safety. Should the current draw exceed the 38 ampere set point, normally closed current switch 42 would open, stopping pump 41 and the flow of electrolytic material 26 into tank 20, 20'. When the current falls back below 38 amperes normally closed current switch 42 would close, and when the current falls below 32 amperes both switch 42 and switch 36 would then both be closed, pump 41 would resume pumping, and electrolytic material 26 would flow into tank 22*a* to increase current back to the 32 ampere range.

In this embodiment, both the pump 41 and valve 110 are energized at the same time to prevent back flow of line pressure into the electrolytic solution container 28 when pump 41 is off.

In another embodiment electrolytic material 26 is provided with a gravity feed unit. In this embodiment, when current sensing switch 36 detects current falling below the 32 ampere set point, current sensing switch 36 closes, turning on normally off solenoid valve 110. Turning on solenoid valve 110 allows gravity flow of electrolytic material 26 into tank 20, 20'. Thus, in either embodiment, electrolytic material 26 is automatically added to tank 20, 20' to achieve a preset current at the line voltage, and this current and voltage provides a preset heating rate.

By contrast, allowing entering liquid 19 to enter tank 20, 20' without also adding electrolytic material 26 dilutes the concentration of electrolyte in conductive liquid 24 in tank 20, 20', lowering conductivity of conductive liquid 24 and lowering the current traveling through conductive liquid 24. Thus, as heated conductive liquid 24 is drawn from tank 20, 20', fresh entering liquid 19 is drawn in, and the conductivity of conductive liquid 24 in tank 20, 20' is continuously adjusted to provide and maintain the desired current level.

Liquid inlet 39 is electrically isolated with dielectric spacer 51 and liquid outflow 40 is electrically isolated with dielectric spacers 53 to isolate inlet metal pipe 30 and outlet metal pipe 54 from tank 20, 20', preventing leakage current from reaching pipes 30, 54. Dielectric spacers 51 and 53 also include grounding cables that connect conductive liquid 24 to ground through an earth leakage protect device. With the earth leakage protect device, if current to ground exceeds a threshold, all current to tank 20, 20' is disconnected. Tank 20, 20' also has its own separate grounding line.

Liquid outflow 40 is connected to the machine or structure (not shown), such as a commercial or domestic dishwasher in which the heated water 56 will be used, for example, for sanitizing dishes.

In the embodiment of FIG. 1*b*, in which tank 20, 20' is unpressurized, for example, at atmospheric pressure, and a level sensing float switch (not shown) in tank 20, 20' controls operation of a solenoid operated fill valve connected to entering liquid inlet 39. The float switch can be part number M8700 from the Madison Company, Branford Conn.

In devices 18, 18' built by applicants, tank 20, 20' had three baffled sections 20*a*, 20*b*, 20*c*. Preheated municipal water entered at water inlet 39 located at bottom 62 of first tank section 20*a*, as shown in FIGS. 1*a*, 1*b*. Salt water electrolytic material 26 was added in tank section 20*a* to provide conductive solution 24.

Conductive liquid 24 was heated by current flowing through conductive liquid 24 between electrode plates 22*a*-22*a*', 22*b*-22*b*', 22*c*-22*c*' of first electrode set 22 in first tank section 20*a*. Heated conductive liquid 24 rose to top 68 of first tank section 20*a* and flowed out of first tank section 20*a* through holes 74 at top 76 of first baffle wall 78 and entered middle tank b. Conductive liquid 24 then flowed out of middle tank 20*b* through holes 86 at bottom 88 of second baffle wall 90 and into third tank section 20*c* where it was heated by current flowing through conductive liquid 24 between electrode plates 23*a*-23*a*', 23*b*-23*b*', 23*c*-23*c*' in second electrode set 23. Heated conductive liquid rose to top 102 of third tank section 20*c*, and the further heated conductive liquid exited through conductive liquid outflow 40 of third tank section 20*c*.

The present applicants recognized that dissolved solids normally present in municipal water did not precipitate out of the water and did not form lime deposits on electrode plates 22*a*-22*a*', 22*b*-22*b*', 22*c*-22*c*' and 23*a*-23*a*', 23*b*-23*b*', 23*c*-23*c*' as would ordinarily happen if standard electric resistance heaters were used. Lime deposits were absent because electrode sets 22, 23 remain at the temperature of the liquid in which they are immersed, whereas electric resistance heaters ordinarily operate at a much higher temperature. Thus, the present system reduces or eliminates the need for deliming and repairs common to resistance type heaters.

In this embodiment, middle tank section 20*b* has no electrodes; middle tank section 20*b* serves to avoid stratification of the water based on temperature, improving operation. In addition, residence time for water in each tank section is enhanced. Thus, if tank 20, 20' is initially empty, water completely fills first tank section 20*a* before any spills through holes 76 at the top of baffle wall 78 and enters middle tank section 20*b*, maximizing residence time in tank section 20*a*. This heated water then enters the bottom of third tank section 20*c* through holes 86 at the bottom of baffle wall 90 and resides in third tank section 20*c* until third tank section 20*c* fills, and it then exits through outflow 40 at the top of third tank section 20*c*, maximizing residence time in third section 20*c*.

In the atmospheric pressure embodiment, as conductive liquid 24 was drawn from third tank section 20*c* by the dishwasher, float switch 55 turns on solenoid valve 110, and 150 F entering liquid 19, preheated municipal water, was drawn into enter first tank section 20*a*. Float switch 55 was part number M8700 from Madison Company, Branford, Conn. The 150 F preheated municipal water drawn into first tank section 20*a* lowered the concentration of salt in conductive solution 24 in first tank section 20*a*, thereby lowering conductivity of water in this first tank section 20*a*, and lowering the current flowing between first electrode plates 22*a*, 22*b*, 22*c* in first tank section 20*a*. Detecting lowered current below a set point caused current sensitive switch 36 to turn on pump 41 to provide more electrolytic material 26 in first tank section 20*a*. This raised conductivity of conductive liquid 24, raising current flowing between electrodes of electrode sets 22, 23, and caused a higher rate of heating in tank sections 20*a*, 20*c*. Pump 41 continued to operate until the current flowing reached the set point of 32 amperes. At that current sensitive switch 36 turned off pump 41 and flow of electrolytic material 26 into tank section 20*a* temporarily stopped while current continued to flow between electrodes of electrode sets 22, 23. Pump 41 turned on and off to maintain the current flowing at the 32 ampere set point until a preset temperature set point for the water reaching outflow 40 was reached.

In the pressurized system of FIG. 1*a*, float switch 55 was not needed and tank sections 20*a*, 20*b*, 20*c* were continuously kept filled by water line pressure.

Figure 3:
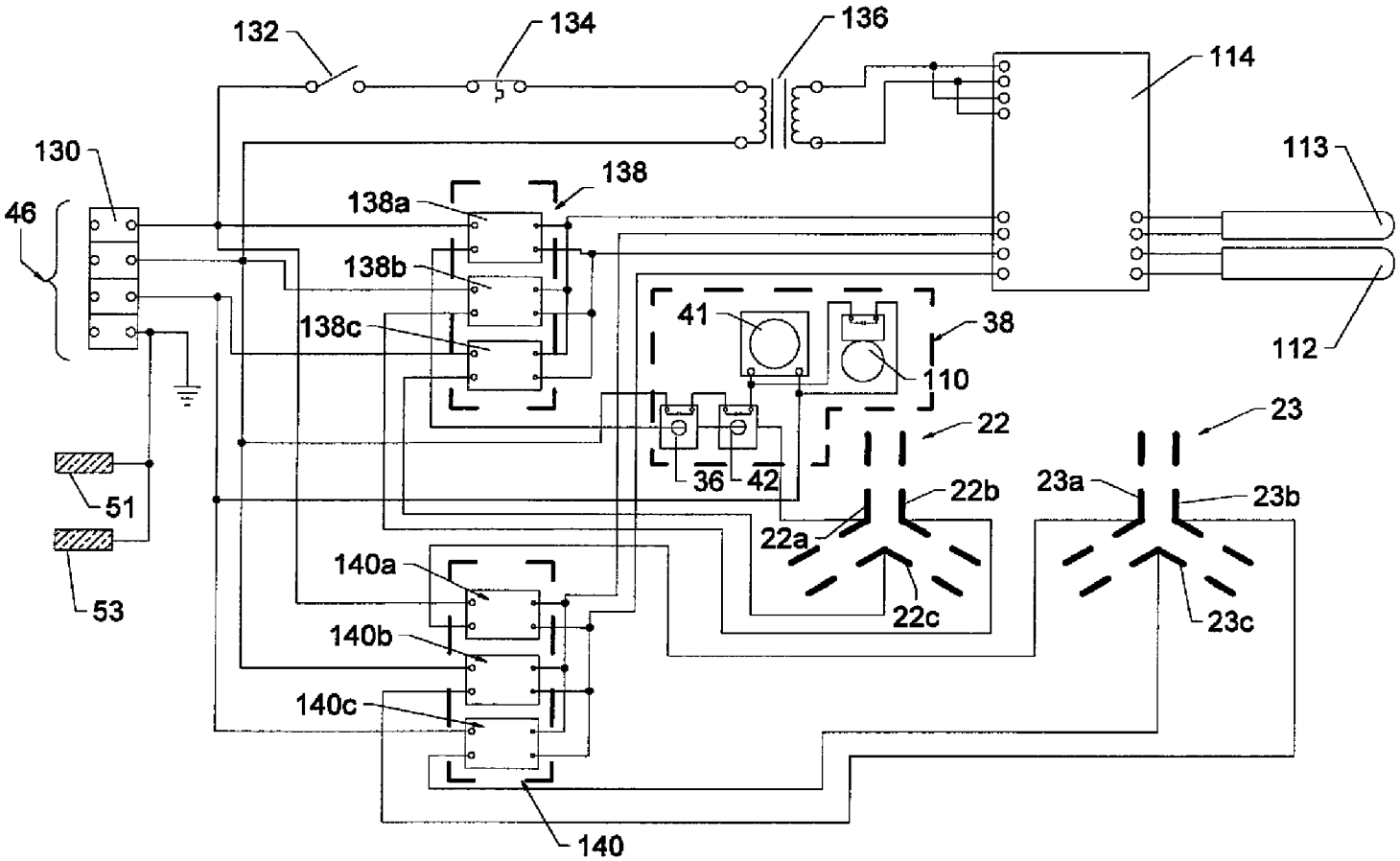
FIG. 3 is a block diagram of the electrical supply and control system for the liquid heating system of FIG. 1*a*.

K type thermocouples were used as temperature sensors 112, 113 to measure temperature of conductive liquid 24 in first tank section 20*a* and in third tank section 20*c* respectively, as shown in FIGS. 1*a*, 1*b*, and FIG. 3. Temperature controller 114 connected to temperature sensors 112, 113 was of a type that turned off current flow to electrode sets 22, 23 if the temperature measured reached a set point, which in the prototype was 200 F. Thus overheating conductive liquid 24 was avoided and a minimum of electrical energy was used to reach the desired temperature. Other temperature sensors can be used, such as thermisters. In the prototype, power was supplied by one power supply to electrode sets in both tank sections. In the prototype, temperature controller 114 was an ECM-40 controller from Athena Controls, Plymouth Meeting, Pa. and type K thermocouples were used.

In the temperature circuit, three phase AC power is fed through field wiring terminal block 130, and distributed in a parallel arrangement to the line and ground sides of electrode sets 22 and 23 through relay sets 138 and 140. Relay set 138 includes 3 solid state relays 138*a*, 138*b*, 138*c* while relay set 140 includes 3 solid state relays 140*a*, 140*b*, 140*c* to provide one solid state relay for each phase of power in each relay set. The load side of solid state relay set 138 is connected to the individual line electrodes 22*a*, 22*b*, 22*c* of electrode set 22, and the load side of solid state relay set 140 is connected to the individual line electrodes 23*a*, 23*b*, and 23*c* of electrode set 23. The load side of solid state relay set 138 is connected to individual electrodes 22*a*', 22*b*', 22*c*' of electrode set 22, and the load side of solid state relay set 140 is connected to the individual electrodes 23*a*', 23*b*', and 23*c*' of electrode set 23. Relay sets 138, 140 can be part number CWD2450 from Crydom, San Diego, Calif.

Power is supplied to temperature controller 114 through main power switch 132, high-limit temperature safety switch 134 and a 208-volt-primary to 18-volt-secondary transformer 136. Temperature feedback from the two temperature sensors 112, 113 is used by temperature controller 114 to determine whether more heat is required in tank section 20*a* or tank section 20*c* to reach a preset temperature set point for each tank section. If more heat is required in one or both tank sections, temperature controller 114 sends a voltage output signal to the coils of solid state relay sets 138 or 140 to close that relay and allow current to flow between electrodes in the respective tank section depending on which requires more heat. In another embodiment, each tank 20*a*, 20*c* has its controller. Temperature controller 114 can be a DCH controller from Antunes Controls, Carol Stream Ill.

High-limit temperature safety switch 134 is included to ensure that an over temperature condition does not occur, preventing harm to the operator or to device 18, 18'. Safety switch 134 is a normally closed bi-metal snap disc style switch that is mounted to the exterior of tank 20, 20' and monitors its surface temperature. If the surface temperature rises above the upper set point of switch 134, switch 134 opens, thereby stopping all current flow to electrode sets 22, 23 and stopping any additional heating of conductive liquid 24 by electrode sets 22 and 23. Switch 134 automatically resets itself to a closed position once temperature declines below a lower threshold. For a system designed to heat water to 200 F, the upper set point of switch 134 could be set at about 250 F and the lower set point at about 220 F.

Electrodes 22*a*-22*c* and 22*a*'-22*c*' were fabricated of graphite plates, as shown in FIGS. 2 and 3. In one experiment, graphite plates had dimensions of 4 inches by 9 inches and were mounted 1.688 inches apart. Each graphite plate was mounted on brackets 121 of type 2 titanium sheet which was connected to leads 120 formed of 0.125 inch diameter type 2 titanium rods extending through dielectrically isolated bushings in tank cover 122, as shown in FIG. 2*a*-2*b*. Applicants found that the graphite electrodes had longer life than electric resistance heaters.

Alternatively, tank 20, 20' may just have a single tank section. One, two, or more electrode sets can be used in the single tank section embodiment. A two tank section system can also be used. In the two tank section embodiment, holes may be provided at the top of the dividing wall. Tank 20 can also have more than three tank sections. To heat conductive liquid 24 that is flowing at a higher flow rate, more electrode sets may be provided, and these may be provided in the additional tanks.

While a system with a three phase AC voltage supply is shown, a single phase system can also be used. While in the example described a 208 volt system was used, any voltage can be used, such as 480 Volts, 240 Volts or 120 Volts. While a control system with a constant voltage source was described a control system with a constant current source and a voltage that varies with conductivity of the conductive liquid can also be used while the system provides control to provide a high voltage.

In one embodiment one power supply is connected in a parallel arrangement to electrode sets 22 and 23 in both tanks 20*a* and 20*c*, as shown in FIG. 3. In this embodiment whichever tank 20*a*, 20*c* has conductive solution 24 with the highest conductivity at a particular moment gets the most current and the most heating. If conductive solution 24 is flowing, current in tank section 20*c* will generally track the current in tank section 20*a* but with a delay for the time it takes for conductive solution 24 to travel from tank section 20*a* to tank section 20*c*. In another embodiment each electrode set is powered by its own power supply. In this embodiment, the two power supplies can provide the same phase and voltage. Alternatively, the two power supplies provide different voltages and/or different phases.

In one embodiment, current is supplied to electrodes 22 with alternating current power supply 46, such as a standard 3 phase 208 Volt supply. Other supply and electrode configurations, such as a single phase power supply with a single pair of electrodes can also be used.

In another embodiment with a single power supply connected to temperature controller 114, current is independently pulsed to each set of electrodes 22, 23 as full allowable current. Temperature controller 114 uses pulse width modulation to modulate the current supplied to each electrode set 22, 23, as described in the '794 application, incorporated herein by reference. In this way full current or half-wave current is provided alternatively to each electrode set 22, 23 until the set point temperature is reached. In one embodiment, temperature controller 114 is set to provide a square wave output to switches for each electrode set 22, 23, allowing control of the duty cycle of the two electrode sets. With power to each switching on and off a fraction of the energy is delivered to each electrode set.

In one embodiment, electric current controller 114 includes a circuit that provides electric current to electrodes 22 for a first period of time while not providing any electric current to electrodes 23 during that same first period of time. Then after this first period of time is complete, the circuit in electric current controller 114 provides electric current to electrodes 23 for a second period of time while not providing any electric current to electrodes 22 during that second period of time. This cycle repeats, supplying current to electrodes 22, then to electrodes 23 sequentially. Applicants have built and tested apparatus using this scheme that has a frequency of about ¼ second. In that embodiment, each set of electrodes received full power for ⅛ second intervals separated by ⅛ second gaps during which that set of electrodes received no power and during which the other set of electrodes received the full power. In this manner water in a two containers, each heated by one of the sets of electrodes was heated to boiling while electrodes in each container received nearly the full current that could safely be provided by the wall outlet circuit at a voltage that was equal to or close to the full voltage available from the wall outlet. With a duty cycle of 50%, each container received nearly the maximum current available from the wall outlet circuit, and power provided to both tanks was substantially higher than could be achieved in either a standard parallel or a series circuit arrangement. A standard parallel arrangement would divide the current between the tanks and require a substantially lower voltage across the tanks to avoid the combined current exceeding the maximum current available from the wall outlet circuit. A series arrangement would divide the voltage between the tanks, lowering the power to each. The unique parallel arrangement in this embodiment, of providing current sequentially to the sets of electrodes while adjusting conductivity of the liquid to maintain a preset current level, also permits one of the sets of electrodes to be turned off for an extended period while allowing the other set of electrodes to continue to be in use with the full line voltage applied and the current at a preset value near the maximum allowed by the wall outlet circuit, a feature that would not be available with a series arrangement of the electrodes.

By providing a system in which conductivity of the liquid being heated was varied the present applicants continually provided maximum Voltage while also providing a desired current level near the limit of the wiring, so maximum power could continually be delivered, providing maximum heating rate to the liquid. They could then adjust the duty cycle to avoid exceeding the desired temperature. They could adjust the duty cycle by by going from a full sine wave to pulsed modulation, for example providing a half wave when conductivity of conductive liquid 24 got too high. They could also modulate the conductivity of conductive liquid 24 to adjust the current level. They could also selectively turn on and turn off power to one or more of electrode sets 22, 23 while maintaining conductivity of conductive liquid 24.

Applicants found that the direct heating of water by modulating the conductivity of the water and passing a current passing through the water provided substantially faster heating with better control and efficiency than was available for systems that used a standard resistance heater in the water. They found that using the water itself as the heating element converts electrical energy to heated liquid with less delay. The avoidance of lime buildup, as described herein above also contributes to faster and more efficient heating.

They also found that the direct heating of liquid of the present application overcomes an overshoot problem inherent with the delay in the resistance heating of the liquid. The delay in heat transfer with standard resistance heaters means that electrical energy continues to be provided after enough has already been provided to reach the desired temperature and this temperature is often over shot, wasting energy.

In one experiment, applicants found that device 18, 18' was able to self-adjust to unplanned conditions in order to achieve the results the control system called for. A 200 F temperature was called with the supply water entering inlet 39 at 150 F with a flow rate of 293 gallons per hour. When the supply water temperature fell to only about 90 F device 18' self adjusted to provide the 200 F discharge at the device's flow rate by increasing the amount of time that electrodes 22, 23 were powered in order to provide the additional heat needed to compensate for the lower input water temperatures.

In one experiment they found that the salt added to entering water 19 left no residue on dishes. They found that the apparatus was useful for a booster heater as a separate box that heats water and feeds it to the dishwasher. They recognized that such a heater could also be built into the dishwasher. They also recognized that the system can also be used for primary heating of cold water for residential, commercial, and industrial hot water supply.

While the disclosed methods and systems have been shown and described in connection with illustrated embodiments, various changes may be made therein without departing from the spirit and scope of the invention as defined in the appended claims.

The invention claimed is:

1. A device for heating a liquid, comprising:

a tank, electrodes, and a conductive liquid, wherein said tank holds said conductive liquid and said electrodes, wherein said electrodes are connected to provide a current flowing in said conductive liquid;

a source of electrolytic material switchably connected for providing said electrolytic material to said tank;

an electrical parameter sensor for detecting a parameter of electrical energy dissipated in said conductive liquid; and a controller connected to automatically add said electrolytic material to said conductive liquid if said electrical parameter sensor detects said electrical parameter differing from a set point.

2. A device as recited in claim 1, wherein said parameter is current and wherein said electrical parameter sensor senses current, wherein said controller is connected to automatically add said electrolytic material to said conductive liquid if said current sensor detects said current below said set point.

3. A device as recited in claim 2, further comprising a power supply connected for supplying said current.

4. A device as recited in claim 1, further comprising a device positioned for allowing supply of said electrolytic material to said tank wherein said controller is connected to said device for said automatic adding said electrolytic material to said conductive liquid.

5. A device as recited in claim 4, wherein said controller controls operation of said device.

6. A device as recited in claim 4, wherein said device includes one from the group consisting of a pump and a valve.

7. A device as recited in claim 1, further comprising a liquid outflow, wherein said liquid outflow is connected to a user of the heated liquid.

8. A device as recited in claim 7, wherein said liquid outflow is connected to a dish washer.

9. A device as recited in claim 1, wherein said tank includes a first tank section and a second tank section, wherein said first tank section includes first electrodes and wherein said second tank section includes second electrodes.

10. A device as recited in claim 9, further comprising a power supply, wherein said power supply is connected to provide electrical energy to said first electrodes and to said second electrodes.

11. A device as recited in claim 1, further comprising a temperature sensor and a temperature controller, wherein said temperature controller is connected to provide electrical energy to said electrodes when said temperature is below a temperature set point.

12. A method of heating a liquid, comprising a. providing a tank and electrodes, wherein said electrodes are located in said tank;

b. flowing a conductive liquid between said electrodes wherein said conductive liquid has a conductivity;

c. providing a system for adjusting said conductivity;

d. flowing a current in said liquid between said electrodes;

e. detecting said current flow; and f. using said system to automatically adjust conductivity of said liquid to achieve a desired current flow.

13. A method as recited in claim 12, wherein said automatically adjusting conductivity involves adding an electrolytic material.

14. A method as recited in claim 13, wherein said liquid includes water and wherein said electrolytic material includes a salt.

15. A method as recited in claim 14, wherein said adding an electrolytic material involves adding a solution containing said salt.

16. A method as recited in claim 12, wherein said automatically adjusting conductivity involves using a controller that controls operation of at least one from the group consisting of a pump and a valve.

* * * * *